United States Patent [19]

Morse et al.

[11] 4,291,754

[45] Sep. 29, 1981

[54] THERMAL MANAGEMENT OF HEAT EXCHANGER STRUCTURE

[75] Inventors: Calvin J. Morse; Gabor Kossuth, both of Torrance, Calif.

[73] Assignee: The Garrett Corporation, Los Angeles, Calif.

[21] Appl. No.: 955,114

[22] Filed: Oct. 26, 1978

[51] Int. Cl.[3] ..... F28D 7/02; F28F 3/08

[52] U.S. Cl. ..... 165/165; 165/167

[58] Field of Search ..... 165/165, 166, 167

[56] References Cited

U.S. PATENT DOCUMENTS

| | | | |
|---|---|---|---|
| 2,615,688 | 10/1952 | Brumbaugh . | |
| 2,658,728 | 11/1953 | Evans, Jr. . | |
| 2,661,200 | 12/1953 | Ohlander . | |
| 2,986,454 | 5/1961 | Jewett . | |
| 3,504,739 | 4/1970 | Pearce . | |
| 3,757,855 | 9/1973 | Kun et al. | 165/166 |
| 3,945,434 | 3/1976 | Parker et al. | 165/166 |
| 4,073,340 | 2/1978 | Parker | 165/166 |
| 4,134,195 | 1/1979 | Jacobsen et al. | 165/166 |

OTHER PUBLICATIONS

Parker, K. O., "Plate Regenerator Boosts Thermal and Cycling Efficiency", *The Oil and Gas Journal,* 4/11/77, pp. 74–78.

*Primary Examiner*—Alfred E. Smith
*Assistant Examiner*—Janice A. Howell
*Attorney, Agent, or Firm*—Henry M. Bissell; Albert J. Miller; Joel D. Talcott

[57] ABSTRACT

Methods and apparatus for heating or cooling heat exchanger manifolds and side bars during transient operation to control structural deformation and resultant stresses. Special internal passages are provided in the manifolds and side bars of a plate-and-fin heat exchanger through which heated air is diverted during operation of the heat exchanger, thus serving to stabilize the temperature of selected portions of the heat exchanger in line with operating temperatures of related heat exchanger elements. This serves to minimize thermal gradients and resultant thermal stresses in the overall heat exchanger structure.

18 Claims, 9 Drawing Figures

THERMAL MANAGEMENT OF HEAT EXCHANGER STRUCTURE

INTRODUCTION

Heat exchangers incorporating apparatus of the present invention have been developed for use with large gas turbines for improving their efficiency and performance while reducing operating costs. Heat exchangers of the type under discussion are sometimes referred to as recuperators, but are more generally known as regenerators. A particular application of such units is in conjunction with gas turbines employed in gas pipe line compressor drive systems.

Several hundred regenerated gas turbines have been installed in such applications over the past twenty years or so. Most of the regenerators in these units have been limited to operating temperatures not in excess of 1000° F. by virtue of the materials employed in their fabrication. Such regenerators are of the plate-and-fin type of construction incorporated in a compression-fin design intended for continuous operation. However, rising fuel costs in recent years have dictated high thermal efficiency, and new operating methods require a regenerator that will operate more efficiently at higher temperatures and possesses the capability of withstanding thousands of starting and stopping cycles without leakage or excessive maintenance costs. A stainless steel plate-and-fin regenerator design has been developed which is capable of withstanding temperatures to 1100° or 1200° F. under operating conditions involving repeated, undelayed starting and stopping cycles.

The previously used compression-fin design developed unbalanced internal pressure-area forces of substantial magnitude, conventionally exceeding one million pounds in a regenerator of suitable size. Such unbalanced forces tending to split the regenerator core structure apart are contained by an exterior frame known as a structural or pressurized strongback. By contrast, the modern tension-braze design is constructed so that the internal pressure forces are balanced and the need for a strongback is eliminated. However, since the strongback structure is eliminated as a result of the balancing of the internal pressure forces, the changes in dimension of the overall unit due to thermal expansion and contraction become significant. Thermal growth must be accommodated and the problem is exaggerated by the fact that the regenerator must withstand a lifetime of thousands of heating and cooling cycles under the new operating mode of the associated turbo-compressor which is started and stopped repeatedly.

Confinement of the extreme high temperatures in excess of 1000° F. to the actual regenerator core and the thermal and dimensional isolation of the core from the associated casing and support structure, thereby minimizing the need for more expensive materials in order to keep the cost of the modern design heat exchangers comparable to that of the plate-type heat exchangers previously in use, have militated toward various mounting, coupling and support arrangements which together make feasible the incorporation of a tension-braze regenerator core in a practical heat exchanger of the type described.

Heat exchangers of the type generally discussed herein are described in an article by K. O. Parker entitled "Plate Regenerator Boosts Thermal and Cycling Efficiency", published in *The Oil & Gas Journal* for Apr. 11, 1977.

BACKGROUND OF THE INVENTION

1 Field of the Invention

This invention relates to plate-and-fin heat exchangers and, more particularly, to arrangements for improving the structural integrity of such apparatus when subjected to transitional operating conditions.

2. Description of the Prior Art

Devices have long been known for utilizing heating or cooling fluids for the purpose of limiting temperature differentials and thermal gradients. Arrangements are also well known in the prior art which control the flow of a heating or cooling fluid to limit the effect thereof during transitional operating stages and to maintain operating temperatures within preselected ranges. An example of the latter is the thermostat commonly found in an automotive cooling system. This virtually blocks flow of a coolant to the engine when the engine is cold and, during the normal operating phase, variably restricts the coolant flow in accordance with the desired steady state operating temperature of the engine, the boiling point of the coolant or particular constituents thereof, and the demands of related equipment, such as a heater which draws heat from the engine coolant to heat the passenger compartment.

U.S. Pat. No. 2,658,728 of Evans, Jr., U.S. Pat. No. 2,986,454 of Jewett, U.S. Pat. No. 2,615,688 of Brumbaugh, and U.S. Pat. No. 3,504,739 of Pearce are examples of disclosures involving the use of an intermediate fluid in heat exchangers generally of the tube and sheet type to provide physical separation between, and reduce the thermal gradients and shock in respective chambers or other heat transfer structure containing the respective heat exchange media.

The Ohlander U.S. Pat. No. 2,661,200 discloses an arrangement for introducing a gas into a heat sensitive region of a refractory nozzle to limit the maximum temperature of the protected region. This patent, as well as the aforementioned Jewett and Pearce patents, also discloses the use of the related apparatus for preheating the tempering fluid.

Insofar as is known, however, none of the prior art arrangements disclose the utilization of a gaseous fluid for heating or cooling selected portions of a heat exchanger during the starting up or shutting down transitional phases between steady state operating conditions and shutdown. In particular, this concept has not previously been applied to plate-and-fin heat exchanger manifolds in the manner of the present invention.

SUMMARY OF THE INVENTION

In brief, particular arrangements in accordance with the present invention include specially provided passages for diverting and directing one of the heat exchange fluids to portions of the manifolds which, by virtue of their structural configration and position, would otherwise encounter a thermal lag—and thereby thermal stress—relative to other portions of the structure. Special provision is also made for directing another of the heat exchange fluids and for controlling the flow thereof to boundary portions of the structure which also encounter thermal lag. The heat exchangers here involved comprise a central counterflow section with end sections of the cross-flow type through which air is directed between the central section and the respective manifolds.

In particular methods of fabricating heat exchangers and apparatus provided thereby in accordance with the present invention, the tube plates of a plate-fin heat exchanger include the passages which carry a small portion of the compressed air passing through the heat exchanger about the periphery of the heat exchanger, particularly the portions of the heat exchanger manifolds which are remote from the core, to accelerate the heating or cooling, as the case may be, of these portions by convection beyond the rate of heating or cooling which would otherwise be encountered. This advantageously serves to maintain the temperature throughout the entire structure more uniform during the transitional phases between steady state operation and shutdown, thereby removing the heat exchanger as a limiting factor in the time duration of the programmed regime for starting up or shutting down the regenerated turbine system in which the heat exchanger is employed.

DETAILED DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENTS

Figure 1:
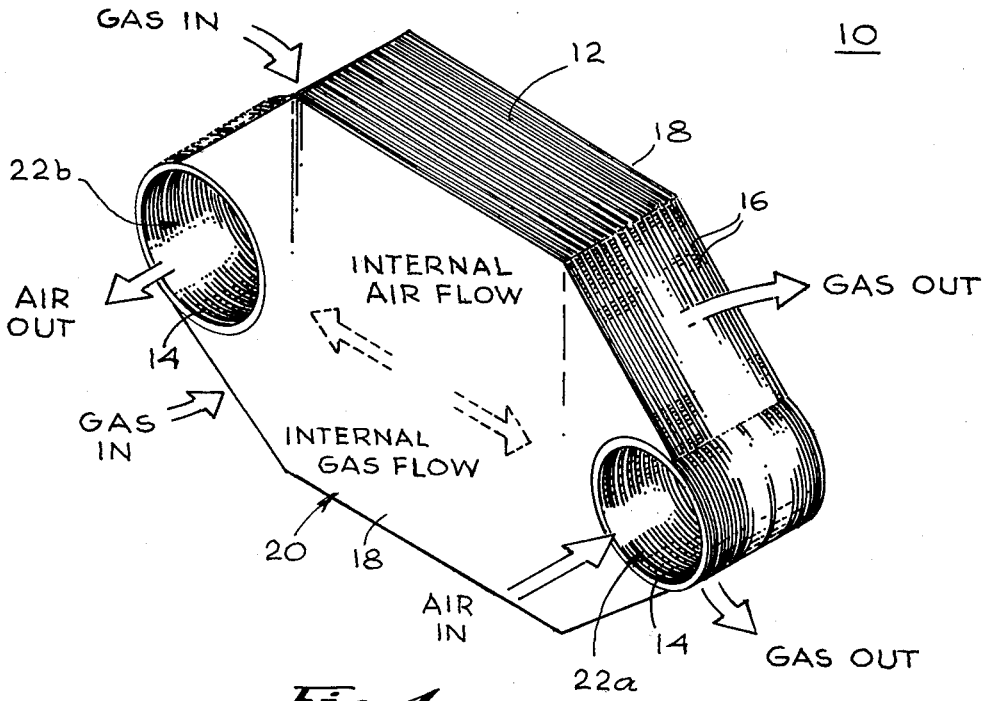
FIG. 1 is a diagrammatic view in perspective of a heat exchanger core section including apparatus of the present invention.

FIG. 1 illustrates a brazed regenerator core as utilized in heat exchangers of the type discussed hereinabove. The unit 10 of FIG. 1 is but one section of a plurality (for example, six) designed to be assembled in an overall heat exchanger module. The core section 10 comprises a plurality of formed plates 12 interleaved with fins, such as the air fins 14 and the gas fins 16, which serve to direct the air and exhaust gas in alternating adjacent counterflow passages for maximum heat transfer. Side plates 18, similar to the inner plates 12 except that they are formed of thicker sheets, are provided at opposite sides of the core section 10. When assembled and brazed to form an integral unit, the formed plates define respective manifold passages **22*a* and 22*b* at opposite ends of the central counterflow heat exchanging section 20** and communicating with the air passages thereof.

As indicated by the respective arrows in FIG. 1, heated exhaust gas from an associated turbine enters the far end of the section 10, flowing around the manifold passage **22*b*, then through the gas flow passages in the central section 14 and out of the section 10 on the near side of FIG. 1, flowing around the manifold 22*a*. At the same time, compressed air from the inlet air compressor for the associated turbine enters the heat exchanger section 10 through the manifold 22*a*, flows through internal air flow passages connected with the manifolds 22*a*, 22*b* through the central heat exchanging section 20, and then flows out of the manifold 22*b*** from whence it is directed to the burner and associated turbine (not shown). In the process the exhaust gas gives up substantial heat to the compressed air which is fed to the associated turbine, thereby considerably improving the efficiency of operation of the regenerated turbine system.

Heat exchangers made up of core sections such as the unit 10 of FIG. 1 are provided in various sizes for regenerated gas turbine systems in the range of 5000 to 100,000 hp. In the operation of a typical system employing a regenerating heat exchanger of this type, ambient air enters through an inlet filter and is compressed to from 100 to 150 psi, reaching a temperature of approximately 600° F. in the compressor section of the gas turbine. It is then piped to the heat exchanger core where the air is heated to about 900° F. by the exhaust gas from the turbine. The heated air is then returned to the combustor and turbine sections of the associated engine via suitable piping. The exhaust gas from the turbine is at approximately 1100° F. and essentially ambient pressure. The exhaust gas drops in temperature to about 600° F. in passing through the core section 10 and is then discharged to ambient through an exhaust stack. In effect, the heat that would otherwise be lost is transferred to the turbine inlet air, thereby decreasing the amount of fuel that must be consumed to operate the turbine. For a 30,000 hp turbine, the regenerator heats 10 million pounds of air per day in normal operation.

The regenerator is designed to operate for 120,000 hours and 5,000 cycles without scheduled repairs, a lifetime of 15 to 20 years in conventional operation. This requires a capability of the equipment to operate at gas turbine exhaust temperatures of 1100° F. and to start as fast as the associated gas turbine so there is no requirement for wasting fuel to bring the system on line at stabilized operating temperatures. It will be understood that prior art heat exchanger structures are directed more for continuous operation of the regenerated turbine system. Thus, such systems have been able to tolerate the additional time and fuel consumption required to bring such a heat exchanger up to stabilized operating temperatures on a gradual basis and to cool the unit down at such time as the turbine is being shut down. However, the current procedures of operating regenerated turbines on a cyclic start-stop basis render special start-up and shutdown regimes, formerly required to accommodate the limitations of the heat exchanger, obsolete.

Certain regimes must be followed during the start-up and shutdown of the turbine to accommodate the limitations of the turbine structure during these transitional phases. Thus, when a turbine is being started, it is first brought to approximately 20% of operating speed, at which time the combustor is lit off. Thereafter, under a controlled program, the turbine is eventually brought up to speed. A similar program is followed during shutdown. It is important from the operating standpoint of the overall regenerated turbine system that the heat exchanger included therein be capable of accommodating to the regime dictated by the limitations of the turbine structure. The use of the thin formed plates, fins and other components making up the brazed regenerator core section such as the unit 10 of FIG. 1 contribute to this capability. However, there are certain portions of the heat exchanger core section where thermal stresses may be concentrated or where the structure may be weaker than at others, and it is these portions to which the present invention is directed.

Figure 2:
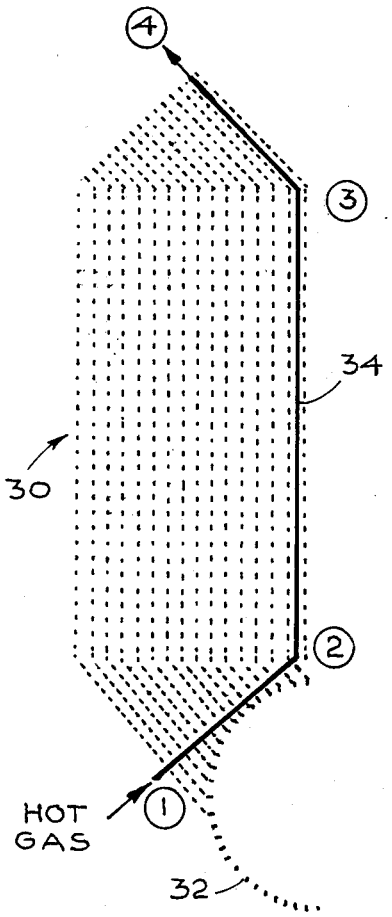
FIG. 2 is a diagrammatic representation of a portion of the arrangement of FIG. 1 as utilized in a corresponding computer model.
Figure 3:
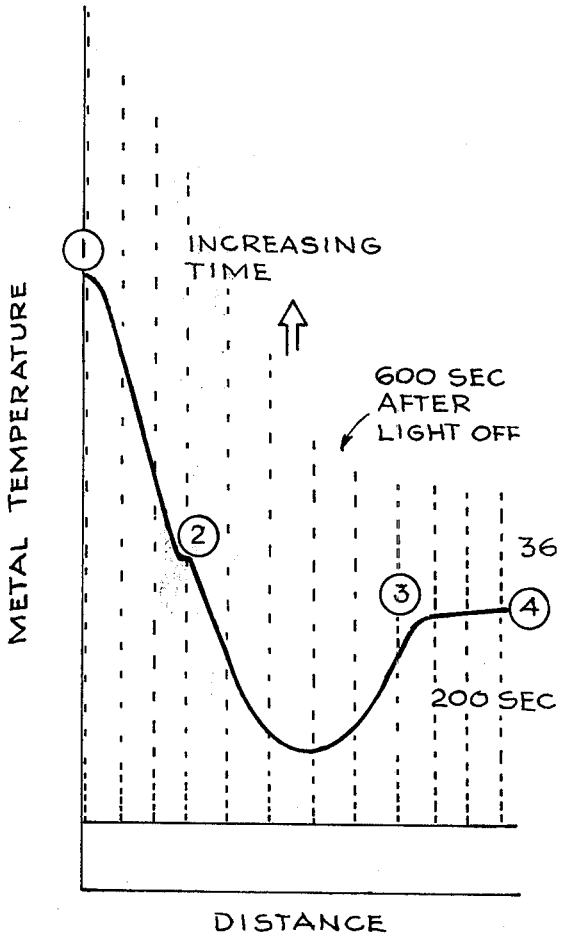
FIG. 3 is a chart showing metal temperature at different points in the computer model of FIG. 2 over a period of time following turbine light off.

FIGS. 2 and 3 are presented to illustrate the temperatures and thermal gradients encountered in heat exchangers of the type described herein. FIG. 2 shows a nodal system used in one specific regenerator computer model. This represents a portion 30 of the core section 10 of FIG. 1. Since the core is symmetrical, only half of the core is modeled. The circular section 32 is the hot end manifold; the cold manifold was not modeled because it is not in a region of potential thermal fatigue.

FIG. 3 is a graph corresponding to the computer printout of temperatures along the heavy line 34 of FIG. 2 from turbine lightoff to 600 seconds after lightoff. The heavy line 36 in FIG. 3 shows temperatures along the heavy line 34 of FIG. 2 for the point in time 200 seconds after lightoff, the ordinates 1, 2, 3 and 4 along the line 36 corresponding to the points 1, 2, 3 and 4 along the line 34 of FIG. 2.

Figure 4:
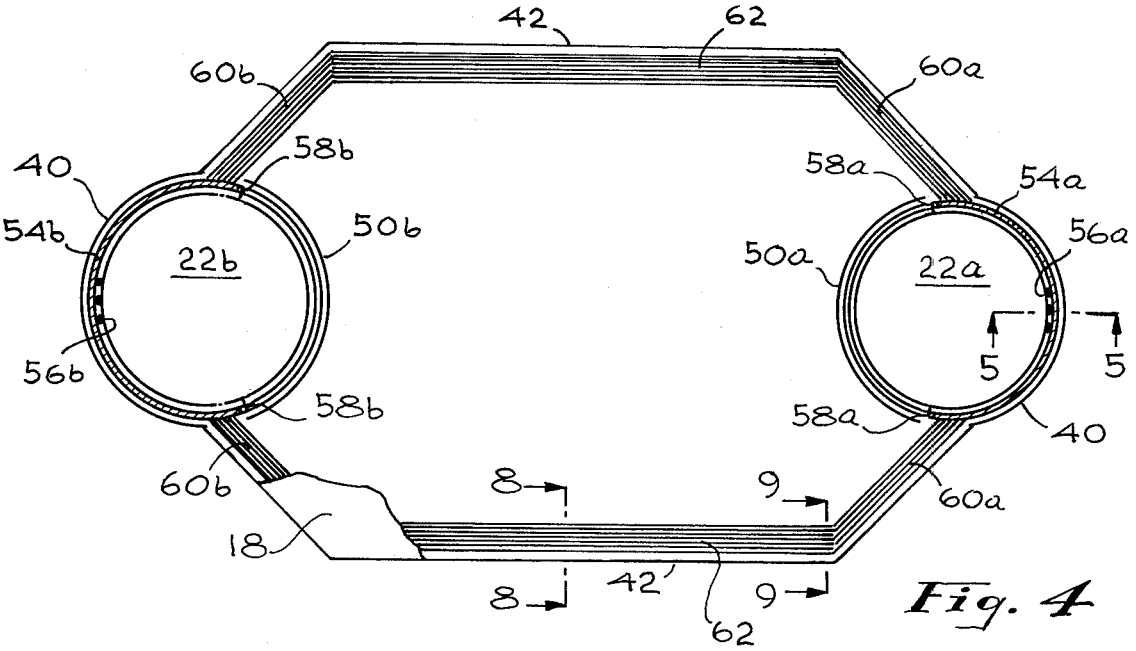
FIG. 4 is a diagrammatic representation of the core section of FIG. 1 in side elevation, showing internal passages in accordance with the present invention.

By virtue of the construction of the core section 10 of FIG. 1, boundary portions along the periphery thereof comprise heavier (i.e. thicker) elements than the plate and fin elements inside the core. These may be seen in FIG. 4 as comprising the outer portions 40 of the manifold sections 22*a*, 22*b* and the side bars 42. In accordance with the present invention, special provision is made to direct fluids to these portions to provide heating or cooling during the transitional phases between steady state operation and shutdown.

Figure 5:
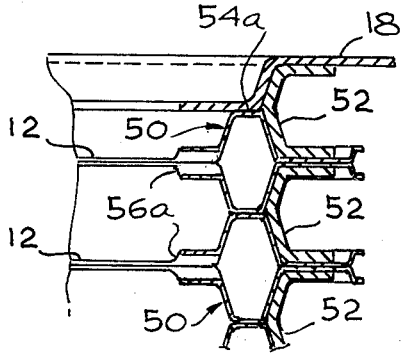
FIG. 5 is a sectional view taken along the lines 5—5 of FIG. 4.

In the fabrication of the heat exchanger core sections, each tube plate 12, 18 is provided with a trough or ring portion surrounding the respective manifold section openings, which portion is offset from the plane of the plate. These may be seen in FIGS. 4 and 5 as the rings 50 surrounding the manifold openings 22*a* and 22*b* in the plates 12. For added strength, a plurality of hoops 52 are provided encircling the manifolds 22*a*, 22*b*. Because of the added thickness of these hoops 52, relative to the thin tube plates 12, there is an inherent thermal lag in this manifold structure, particularly in the outer portions 40 which are not adjacent any of the air and gas fins in the remainder of the heat exchanger core. This is compensated for in arrangements in accordance with the invention by utilizing selected portions of the rings 50*a*, 50*b* (FIG. 4), indicated by the shaded portions 54*a* and 54*b*, as air flow passages to and from which the manifolds 22*a*, 22*b* air is specially directed via openings 56*a*, 56*b*. The terminal end of the shaded portion 54*a* communicates with air fin passages 60*a* at the inlet end which in turn communicate with air fin passages 62 along the sides of the heat exchanger core in the central, heat exchanging section. Similar fin passages 60*b* take the air from the central passages 62 and direct it to the ring passage 54*b* where it is returned to the outlet manifold 22*b* via openings 56*b*. Plugs 58*a* and 58*b* are mounted in the rings 50*a*, 50*b* to divert the air through the associated finned passages 60 and 62.

Figure 7:
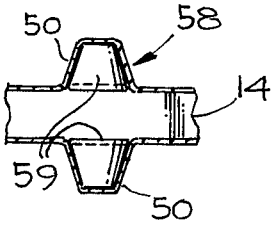
FIG. 7 is an enlarged sectional view taken along the lines 7—7 of FIG. 6.
Figure 6:
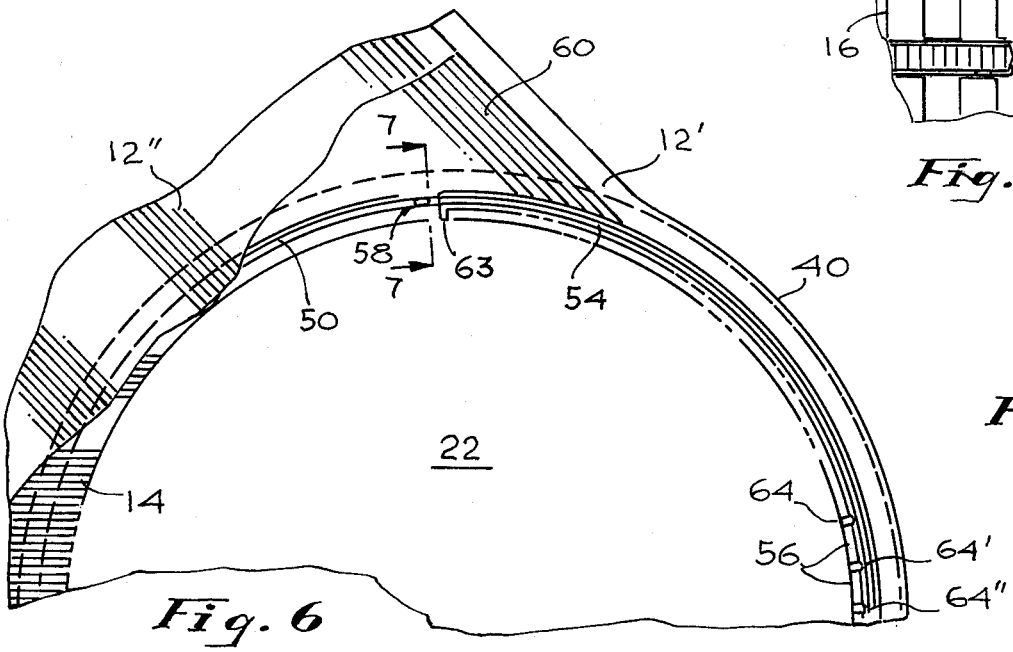
FIG. 6 is an enlarged view, partially broken away, of a portion of the arrangement shown in FIG. 4.

As particularly shown in FIG. 6, which is a view of a pair of tube plates 12', 12'' in the region of the manifold 22, the upper tube plate 12'' being broken away to show the lower plate 12', the associated air passages 60 and some of the air fins 14 (see FIG. 1), the latter communicating with the manifold 22. The ring 50 extending about the manifold opening 22 is shown containing a plug 58 which blocks this passage at the point indicated. As seen in FIG. 7, a sectional view of the plug 58, the plug 58 comprises upper and lower tabs 59 mounted in the ring sections 50 on opposite sides of air fin 14 and joined thereto. A transition section 63 of the plate 12' marks the beginning of the opening for the fins 14 extending through the ring sections 50 to communicate with the manifold 22. A similar transition portion 64 marks one side of the opening 56. Between the transition portions 63 and 64, the ring 54 of the tube section comprising the plates 12', 12'' is sealed off from the manifold 22. Similar transition portions 64' and 64'' mark boundaries for the openings 56 between the manifold 22 and the ring 50.

During start-up operation, for example, compressed air at elevated temperature is introduced to the core via the inlet manifold 22*a*. This air passes along the passages defined by the fins 14 to the central part of the core and raises the temperature of the core in accordance with the temperature of the air. A portion of the air is bled off automatically through the openings 56 where it is caused to flow about the outer manifold portions 40 to heat these portions also as the central core section is being heated, thereby limiting the thermal gradients and related thermal stress between the respective portions of the heat exchanger core. When the turbine is lit off, after the core has been elevated in temperature from the heat of the compressed air as described, the exhaust gases bring the temperature of the core up further to steady state operating temperatures as the turbine is brought up to speed. During this period of the start-up phase, the outer portions of the manifolds are in the exhaust gas stream so they receive some heating directly from the exhaust gas, but those in the outlet manifold side also continue to receive heat from the continued flow of air through the passages 54 as this air is heated in the finned air passages 60, 62. During the shutdown phase of turbine operation, the turbine is throttled down to reduced speed and the air passing through the heat exchanger also cools down, the flow of this air through the passages 54 at the periphery of the manifold 22 serving to cool the manifold in accordance with the temperature of the remainder of the heat exchanger core.

Figure 8:
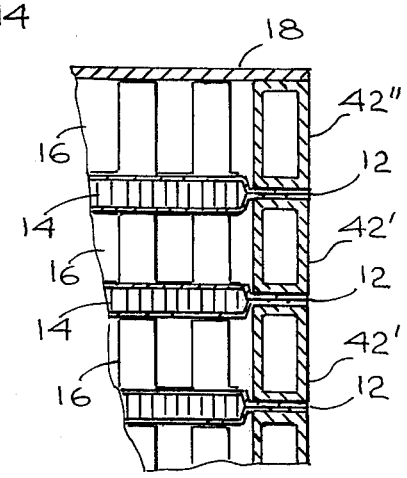
FIG. 8 is a sectional view of a portion of the arrangement of FIG. 4, taken along the lines 8—8.

FIG. 8 illustrates an arrangement in accordance with the present invention for controlling the temperature of the side bars 42' and 42'' during the transitional phases of operation. In this view, taken along the line 8—8 of FIG. 4, a side plate 18 and a plurality of inner plates 12 are shown, together with associated air fins 14 and gas fins 16. The side bars 42' and 42'' are of hollow tubular construction and heavier material to provide the desired structural support at the edges of the core section 10. These side bars 42' and 42'' are open to the flow of turbine exhaust gas and are thereby heated directly. Since these side bars 42', 42'' are in limited heat exchanging relationship with the air fins 14, they absorb heat from the increasing temperature exhaust gases during the start-up phase of operation at a greater rate, corresponding to their greater mass and tendency for thermal lag. Thus the rate of temperature increase for the side bars 42', 42'' is maintained proportional to the internal structure in the inner gas fins 16 and air fins 14.

Figure 9:
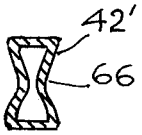
FIG. 9 is an enlarged view of one of the elements shown in FIG. 8, taken along the line 9—9 of FIG. 4.

In accordance with an aspect of the invention, the opposite end portions of the side bars 42' are reduced in cross section to provide limited controlled flow of the exhaust gases through these side bars. This is preferably done by crimping the ends, as shown in the sectional view of the end of side bar 42' in FIG. 9. The uppermost side bar 42'' (FIG. 8) adjacent the side plate 18 is not provided with such a constriction because of its need for additional heat from the exhaust gases flowing therethrough.

Thus, arrangements in accordance with the present invention advantageously serve to provide particularly directed fluid flow passages for diverting and directing the heat exchange fluids to selected portions of the heat exchanger core which would otherwise be subject to severe thermal stress as a result of their location about the periphery of the heat exchanger core. This is accomplished without any moving parts, such as vanes, deflectors or the like, and serves to direct the respective heating or cooling fluids to these peripheral portions automatically in accordance with the need for temperature compensation during the transitional stages of operation. Once the system has been brought up to steady state operating temperatures, the preheating passages continue to serve as part of the overall heat exchanging system.

Although there have been shown and described herein particular methods and apparatus for the thermal management of a heat exchanger manifold in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. In a heat exchanger core of the plate and fin type having integral manifolds and heat exchange portions, apparatus defining passages for directing portions of the heat exchanging fluids to selected portions of the heat exchanger about the periphery thereof comprising:

a plurality of air passages extending along a selected portion of the heat exchanger manifolds in heat conducting relationship therewith;

means for connecting said passages between inlet and outlet manifolds in heat exchanging relation with hot gas passages in the heat exchanger; and means for connecting said passages with the interior of their associated manifolds at selected positions about the periphery of the manifolds for directing a portion of the compressed air conducted by the manifolds through said passages.

2. The apparatus of claim 1 wherein said air passages are between pairs of tube plates and comprise a ring portion extending at least about the outer periphery of the manifolds in a region remote from the heat exchanging section of the heat exchanger core.

3. The apparatus of claim 2 wherein said ring portion surrounds the associated manifold and further comprising plug means for blocking part of the ring portion to direct air through selected associated air fin passages.

4. The apparatus of claim 3 wherein the plug means comprise a pair of opposed tabs affixed to adjacent opposed plates in respective ring portions thereof, and a fin member extending between said plates and connected to the respective tabs.

5. The apparatus of claim 3 or claim 4 wherein the plug means comprise a pair of plugs in each ring portion symmetrically positioned at opposite sides of the manifold for directing air from the ring portion through air passages extending through the heat exchanger core near the opposite sides thereof.

6. The apparatus of claim 3 or claim 4 further comprising, in each of the adjacent tube plates defining said ring portions, respective transition portions adjacent the plug means for defining sealed sections about the associated manifolds outboard of said plug means, said sections closing off said passages from the associated manifolds except in the region of said connecting means.

7. The apparatus of claim 6 wherein the connecting means comprise shaped portions of the tube plates defining openings to the ring portion.

8. The apparatus of any one of claims 1–4 further comprising a plurality of hollow tubular side bars along opposite sides of the heat exchanger and aligned generally in a direction of exhaust gas flow through the heat exchanger between gas inlet and outlet chambers thereof, and means for directing hot exhaust gas to said side bars.

9. The apparatus of claim 8 wherein said hot exhaust gas directing means means comprise a plurality of openings at opposite ends of the side bars communicating directly with gas inlet and outlet chambers, respectively, of the heat exchanger.

10. The apparatus of claim 8 further comprising means for selectively limiting the flow of exhaust gas through said side bars.

11. Apparatus of claim 10 wherein said limiting means comprise sections of reduced cross-sectional area in said side bars.

12. Apparatus of claim 10 wherein the limiting means comprise sections of reduced cross section adjacent opposite ends of only selected ones of the side bars for restricting the flow of exhaust gas therethrough while permitting unrestricted gas flow through others of said side bars.

13. The method of pre-heating selected peripheral portions of the manifolds of a plate-and-fin heat exchanger core having inlet and outlet manifolds integrally formed at opposite ends of the heat exchanger, comprising the steps of:

forming heat exchanger plates with ring portions extending about the manifold sections thereof;

selectively sealing said ring, portions from communication with said manifolds;

providing openings between said manifolds and a central section of said ring portions outboard of the heat exchanger core for directing air from the manifolds through said ring portions adjacent said central sections for pre-heating said portions; and providing selected finned air passages connected with said ring portions for transmitting air in heat exchanging relationship through the heat exchanger core between said ring portions.

14. The method of claim 13 further including the step of selectively blocking the ring portions to separate an inner section from the central section.

15. The method of claim 13 or claim 14 including directing air between the ring portion central sections through the selected finned air passages.

16. The method of claim 13 or claim 14 further including the steps of providing hollow tube reinforcing side bars along the sides of the heat exchanger core and directing exhaust gas through at least some of the side bars to positively heat the side bars during operation of the heat exchanger.

17. The method of claim 16 including the step of limiting the flow of exhaust gas in selected ones of the side bars to control the heating thereof.

18. The method of pre-conditioning selected isolated portions of a heat exchanger core to reduce the temperature differential between said portions and the remainder of said core during a transitional operating phase comprising the steps of:

providing passages for a first heat exchanging fluid in said isolated portions;

providing openings communicating between said passages and respective adjacent fluid plenums conducting said first fluid; and completing a path for the first fluid through the core between opposed passages for stabilizing the temperature of the isolated portions relative to the remainder of the core.

* * * * *